US009472913B1

(12) United States Patent
Mizrahi

(10) Patent No.: US 9,472,913 B1
(45) Date of Patent: Oct. 18, 2016

(54) POWER ADAPTER WITH A CABLE RETENTION STRUCTURE

(71) Applicant: Mizco International Inc., Avenel, NJ (US)

(72) Inventor: Mike J. Mizrahi, Brooklyn, NY (US)

(73) Assignee: MIZCO INTERNATIONAL INC., Avenel, NJ (US)

( * ) Notice: Subject to any disclaimer, the term of this patent is extended or adjusted under 35 U.S.C. 154(b) by 0 days.

(21) Appl. No.: 14/731,184

(22) Filed: Jun. 4, 2015

Related U.S. Application Data

(60) Provisional application No. 62/165,999, filed on May 24, 2015.

(51) Int. Cl.
*H01R 31/06* (2006.01)
*H01R 27/02* (2006.01)
*H01R 13/72* (2006.01)

(52) U.S. Cl.
CPC ..... *H01R 31/06* (2013.01); *H01R 13/72* (2013.01); *H01R 27/02* (2013.01)

(58) Field of Classification Search
CPC ..... H01R 13/6275; H01R 13/6392; H01R 31/06; H01R 13/627; H01R 13/6271; H01R 13/6272
See application file for complete search history.

(56) References Cited

U.S. PATENT DOCUMENTS

| | | | | |
|---|---|---|---|---|
| 4,607,903 | A * | 8/1986 | Hoshino | H01R 13/6271 439/350 |
| 4,884,978 | A * | 12/1989 | Inaba | H01R 13/6272 439/350 |
| 5,035,644 | A * | 7/1991 | Nakazato | H01R 13/641 200/51.09 |
| 7,134,902 | B1 * | 11/2006 | Lewis | H01R 13/6395 439/372 |
| 7,513,791 | B1 * | 4/2009 | Gary | H01R 13/6395 439/373 |
| 7,524,205 | B1 * | 4/2009 | Lee | H01R 13/6392 439/350 |
| 7,695,305 | B1 * | 4/2010 | Ray | H01R 13/6395 439/359 |
| 9,024,581 | B2 * | 5/2015 | McGinley | H01R 31/065 320/111 |
| 2015/0200491 | A1 * | 7/2015 | Fries | H01R 13/639 439/372 |

* cited by examiner

*Primary Examiner* — Gary Paumen
(74) *Attorney, Agent, or Firm* — Loza & Loza, LLP; Jeffrey T. Burgess

(57) ABSTRACT

A power adapter includes a power plug and a connector port. A cable retention structure is coupled to the power adapter to move between an open position and a closed position. In an open position, a cable grip of the cable retention structure is configured to hold a power cable, e.g. when the power cable is coupled to the connector port. The cable grip cable holds the power cable to help resist disconnection of the power cable from the connector port. In a closed position, the cable retention structure moves to fold over a side of the power adapter. The cable grip of the cable retention structure fits into a cable grip well in the side of the power adapter and is frictionally held within the cable grip well to secure the cable retention structure in the closed position.

16 Claims, 14 Drawing Sheets

POWER ADAPTER WITH A CABLE RETENTION STRUCTURE

TECHNICAL FIELD

The present disclosure relates generally to power adapters, and more particularly, to power adapters with a cable retention structure.

BACKGROUND

A power adapter is used with an electrical device to derive a required voltage or current from a main power supply. A power adapter may be used with an electrical device with no other source of power or with a battery-powered device to charge a battery. A power adapter may include, e.g. an AC adapter, AC/DC adapter, or AC/DC converter. The power adapter thus enables an electrical device to obtain power from a variety of different types of external power supplies, such as a 120V AC supply, 230V AC main supply, a battery, etc.

One type of power adapter includes a cigarette lighter adapter. A cigarette lighter adapter generally includes a power plug that connects to a cigarette lighter socket for providing power from a vehicle battery. The cigarette lighter adapter may also include a USB port that connects to a power cable to provide power to an electrical device in the vehicle. For example, when a device runs low or out of power, a power cable with a USB connector may be coupled to the USB port of the power adapter and to the external device. The cigarette lighter power plug of the power adapter is then plugged into the cigarette lighter socket. Power may then be transferred from the vehicle battery to the power adapter and then through the power cable to the electrical device.

One or more improvements to embodiments of a power adapter are described herein.

BRIEF DESCRIPTION OF THE DRAWINGS

Some embodiments of the apparatus and/or methods in accordance with embodiments of the disclosure are now described, by way of example only, and with reference to the accompanying drawings, in which like reference numerals identify similar components throughout.

SUMMARY

Figure 1:
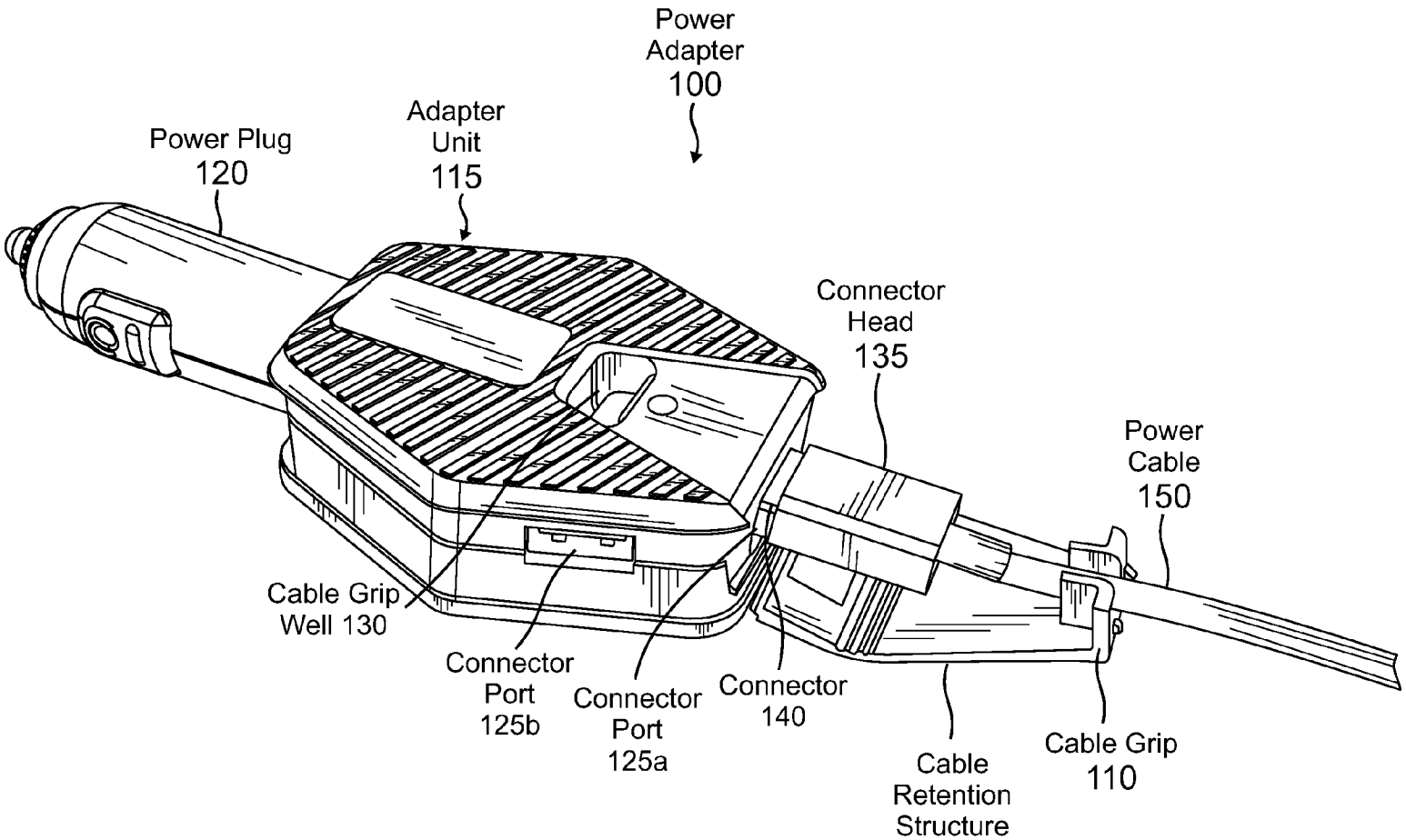
FIG. 1 illustrates a schematic diagram of an embodiment of a power adapter with a cable retention structure with an attached power cable.

The following presents a simplified summary in order to provide a basic understanding of some embodiments. This summary is not an extensive overview and is not intended to identify key or essential elements or delineate the scope of the embodiments herein.

According to one aspect, a power adapter includes an adapter unit including a power plug mounted to a first side of the adapter unit and a connector port in a second side of the adapter unit, wherein the connector port is configured for coupling to a connector head of a power cable. A cable retention structure is attached to the adapter unit, wherein the cable retention structure includes a cable grip configured to hold the power cable.

In another aspect, the cable retention structure comprises an attachment mechanism that attaches the cable retention structure to the adapter unit such that the cable retention structure is operable to move between an open position and a closed position.

In another aspect, a window is formed within the cable retention structure that overlaps the connector port when the cable retention structure is in a closed position.

In another aspect, the cable grip comprises at least one grip wall that forms a u-shaped grip opening. At least one grip protrusion protrudes from the grip wall and projects into the grip opening. The at least one grip protrusion is configured for frictionally clasping the power cable when the cable retention structure is in the open position.

In another aspect, the cable retention structure further comprises a grip component coupled to the cable grip and a grip hinge coupled between the grip component and the attachment mechanism. The grip hinge is configured to fold the grip component across an exterior side of the adapter unit when the cable retention structure is in the closed position.

In another aspect, a cable grip well is formed within an exterior side of the adapter unit, wherein the cable grip well is configured to hold the cable grip when the cable retention structure is in the closed position.

DETAILED DESCRIPTION

In the following detailed description, only certain exemplary embodiments of the present invention are shown and described, by way of illustration. As those skilled in the art would recognize, the invention may be embodied in many different forms and should not be construed as being limited to the embodiments set forth herein. The description and drawings merely illustrate the principles of various embodiments. It will thus be appreciated that those skilled in the art will be able to devise various arrangements that, although not explicitly described or shown herein, embody the principles herein and in the claims and fall within the spirit and scope of the disclosure. Furthermore, all examples recited herein are principally intended expressly to be only for pedagogical purposes to aid the reader in understanding the principles of the embodiments, and are to be construed as being without limitation to such specifically recited examples and conditions. Moreover, all statements herein reciting principles, aspects, and embodiments, as well as specific examples thereof, are intended to encompass equivalents thereof.

In the context of the present specification, when an element is referred to as being "on" another element, it can be directly on the other element or be indirectly on the other element with one or more intervening elements interposed therebetween. Also, in the context of the present specification, when an element is referred to as being "connected" or "coupled" or "attached" to another element, it can be directly connected or coupled or attached to the other element or be indirectly connected or coupled or attached to the other element with one or more intervening elements interposed therebetween.

In the following description, certain terminology is used to describe certain features of one or more embodiments. The term "opening" or "window" or "well" may refer to any opening formed in a structure and/or component or a hollowed-out place in a structure and/or component, including apertures, bores, cavities, chambers, grooves, notches, passages, recesses, slits, wells and slots. The term "protrusion" may refer to a detent, a catch, or any other suitable object or part projecting in an outward or upward manner from a structure and/or component. The term "attachment mechanism" may refer to a hook, clasp, carabiner, hinge, fastener, or any other type of device or method that may be used for attaching items together.

Overview

A problem sometimes occurs involving the connection of a power cable to a USB port of a power adapter. When the power cable is pulled, it may disconnect from the USB port. This disconnection causes the device to stop charging and leads to an inconvenience to a user. For example, a user may not notice that the power cable has been disconnected and that the device is not charged. To help prevent the disconnection of the power cable from the power adapter, embodiments are described herein of a power adapter with a cable retention structure.

In an embodiment, a power adapter includes a power plug, such as a cigarette lighter adapter plug or electrical socket plug, which is configured to connect to a power source. The power adapter also includes a connector port, such as a type of Universal Serial Bus (USB) port or other type of connector port, operable to connect to a cable, such as a power cable or cord. The power cable may be connected to an electrical device to provide power from the power adapter to the electrical device.

A cable retention structure is attached to the power adapter to move between an open position and a closed position. In an open position, a cable grip part of the cable retention structure is configured to hold the cable, e.g. when the cable is connected to the connector port. The cable grip holds the cable and helps to resist disconnection of the cable from the connector port. In a closed position, the cable retention structure folds over a side of the power adapter. The cable grip of the cable retention structure fits into a cable grip well in the side of the power adapter and is frictionally held within the cable grip well to secure the cable retention structure in the closed position.

The cable retention structure in an open position thus holds the cable to help prevent disconnection of the cable from the power adapter. The cable retention structure may also be moved to a closed position when not in use.

Exemplary Embodiments of the Power Adapter

FIG. 1 illustrates a schematic diagram of an embodiment of a power adapter 100 with a cable retention structure 105. This example illustrates the power adapter 100 with an attached power cable 150. The power adapter 100 includes an adapter unit 115 and a power plug 120 mounted to a first side of the adapter unit 115. In this example, the power plug 120 is a cigarette lighter power plug configured for coupling to a cigarette lighter socket. However, other types of power plugs within the scope of this disclosure may be implemented, such as an electrical outlet plug or any other suitable type of power plug adapted to connect with a power source and supply power.

The adapter unit 115 includes at least one connector port 125*a*. The connector port 125*a* includes e.g., a type of Universal Serial Bus (USB) port, such as a USB port, mini-USB port, micro-USB port. USB is a common industry standard that defines the cables, connectors and communications protocols used for connection, communication, and power supply between devices. The connector port 125*a* may also include an IEEE 802.3af Power over Ethernet (PoE) port, a MIDI port, or other type of port operable to supply power through a cable 110 to an external device. The adapter unit 115 may also include an additional connector port 125*b*. The additional connector port 125*b* may be the same type of connector port or a different type of connector port. For example, the first connector port 125*a* may be a USB port while the second connector port 125*b* may be a mini-USB port or MIDI port. The power cable 110 includes a connector head 135 configured to house a connector 140. The connector 140 is shaped to fit into one of the connector ports 125*a*, 125*b*.

In an embodiment, the adapter unit 115 may also include a transformer to convert the main power supply (such as the vehicle battery) from a higher voltage to a lower voltage. In some embodiments, the adapter unit 115 may also include an AC to DC converter to convert an AC main power supply to a DC power. For example, the AC to DC converter includes a rectifier circuit (such as a bridge rectifier) to convert the AC to a DC power supply and a filter to smooth the DC waveform. The adapter unit may also include other components not shown herein.

The adapter unit 115 also includes a cable retention structure 105 attached near at least one of the connector ports 125, such as connector port 125*a* in the example of FIG. 1. In one or more embodiments, the cable retention structure 105 is moveably attached to the adapter unit 115 to pivot, swivel, flip, fold, rotate, slide or otherwise move between an open position and a closed position. For example, in this embodiment, the cable retention structure 105 is attached by a hinge to pivot, rotate or flip between an open position and a closed position. In other embodiments, the cable retention structure 105 may be attached with tracks to the adapter unit 115 and may slide between an open position and a closed position.

A cable grip 110 is mounted to the cable retention structure 105. The cable grip 110 is configured to hold the attached power cable 150 when the cable retention structure is in an open position. A cable grip well 130 is formed within an exterior side of the adapter unit 115 and configured to frictionally clasp or hold the cable grip 110 when the cable retention structure 105 is in a closed position.

In use, the cable retention structure is moved from a closed position to an open position. The connector 140 of the power cable 110 is inserted into the connector port 125*a*, and the power cable 110 is inserted into the cable grip 110. The cable grip 110 holds the power cable 110 to resist the disconnection of the connector 140 from the connector port 125*a*. The cable grip 110 may frictionally clasp the power cable 110 or assert pressure to grip the power cable 110 or a combination thereof.

Figure 2:
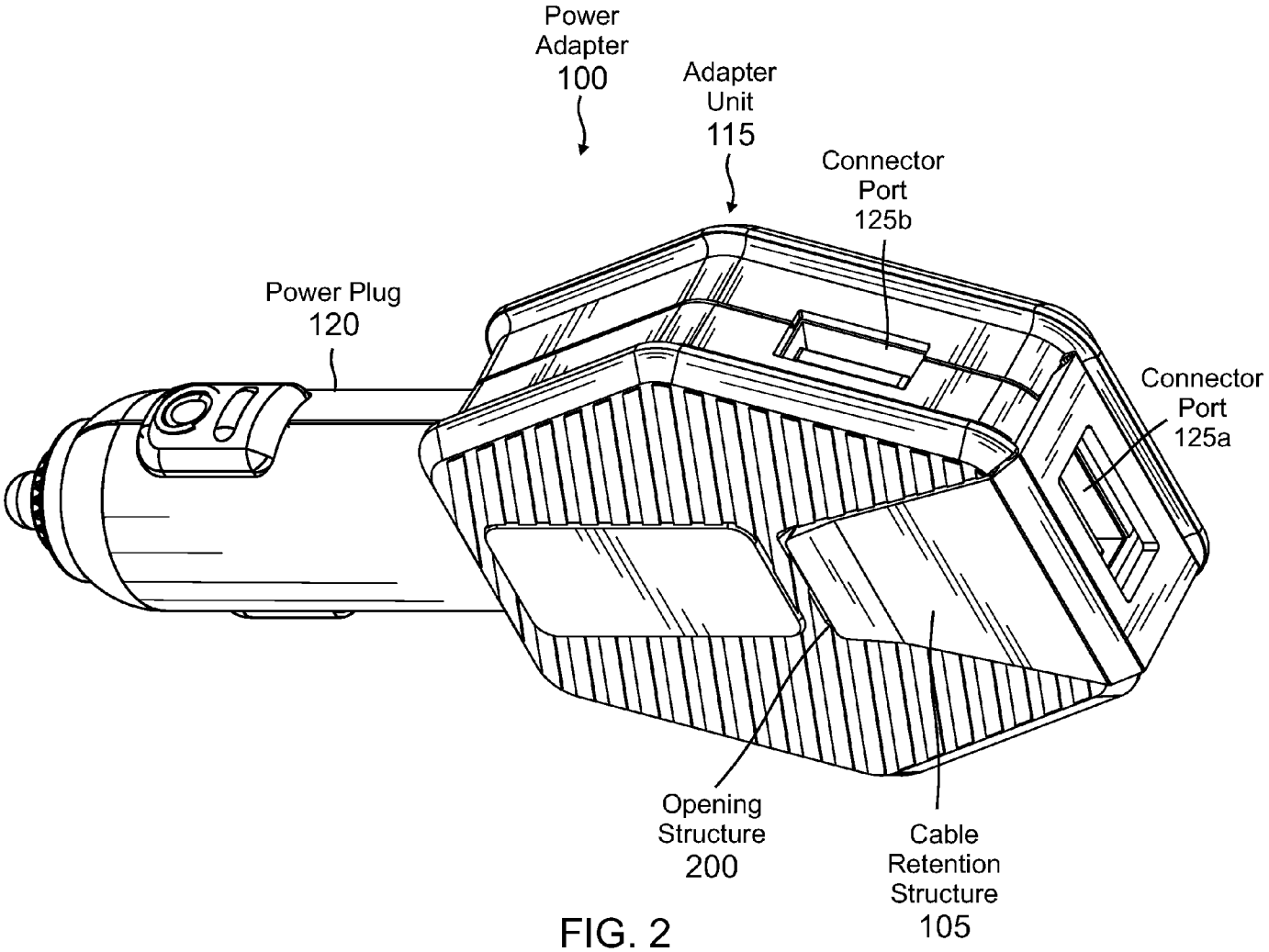
FIG. 2 illustrates a schematic diagram of an embodiment of a power adapter with a cable retention structure in a closed position.

FIG. 2 illustrates a schematic diagram of an embodiment of the power adapter 100 with the cable retention structure 105 in a closed position. In a closed position, the cable retention structure 105 is folded over a side of the adapter unit 115. The cable grip 110 fits at least partially or fully within the cable grip well 130.

To open, an end of the cable retention structure 105 forms an opening structure 200. The opening structure 200 provides a mechanism to assist in removing or releasing the cable grip 110 from the cable grip well 130. In an embodiment, the opening structure 200 is a slot formed in the end of the cable grip 110 that protrudes from the cable grip well 130 when the cable retention structure is in a closed position. In use, leverage is applied to the slot to lift the cable grip 110 from the cable grip well 130. Other types of opening structures 200 may also be employed alternatively or in addition to the slot, such as a tab or grip or handle.

In the embodiments shown, the adapter unit 115 has an approximately hexagonal shape though other shapes may be implemented as described in more detail herein. A connector port 125 is formed within at least one side of the hexagonally shaped adapter unit 115. In other embodiments, a connector port 125 is implemented in a plurality of sides of the hexagonally shaped adapter unit 115. In yet other embodiments, a plurality of connector ports 125 may implemented in on one side of the hexagonally shaped adapter unit 115.

Figure 3:
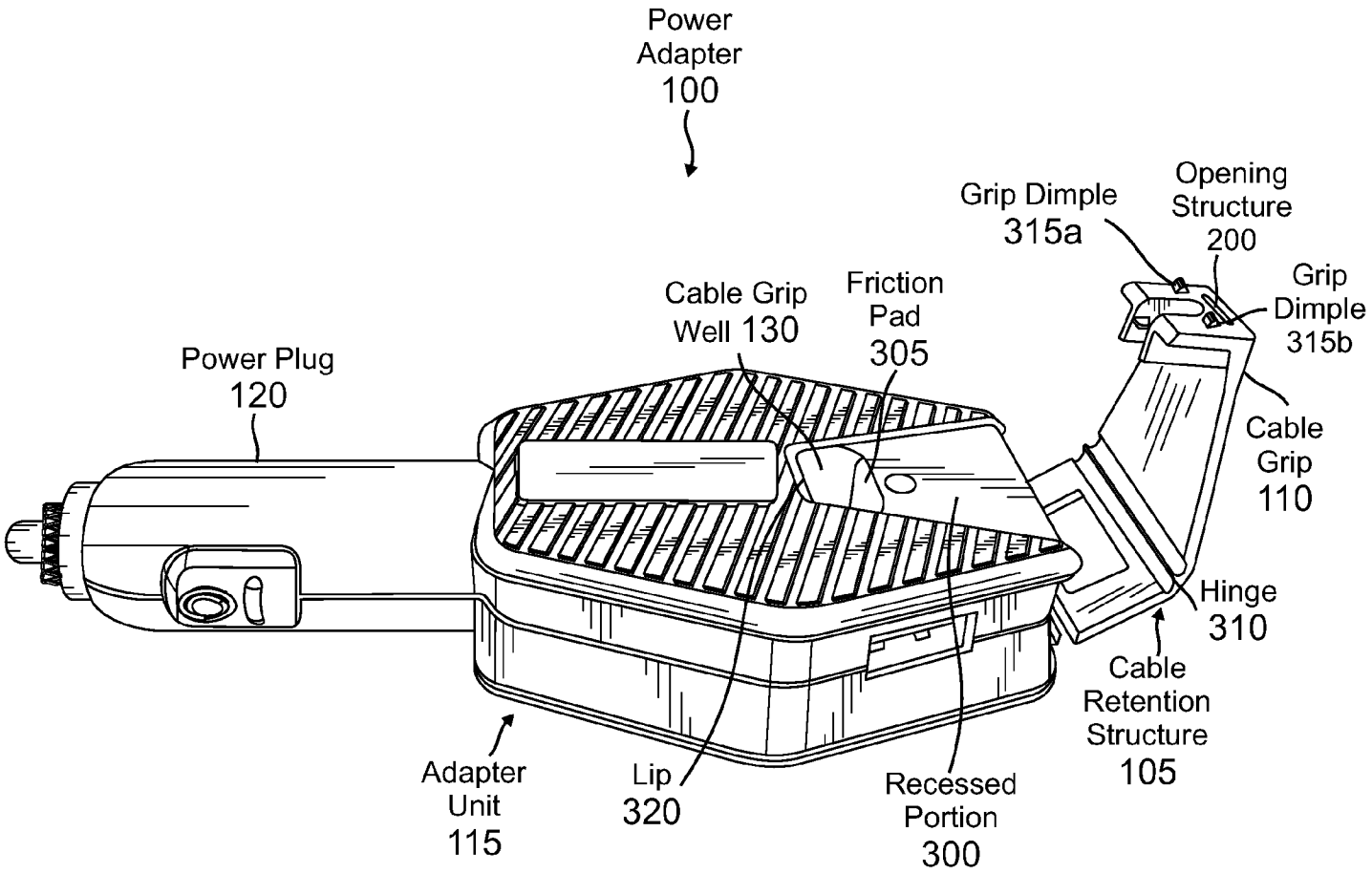
FIG. 3 illustrates a perspective bottom view of a schematic diagram of an embodiment of the power adapter with the cable retention structure in an open position.

FIG. 3 illustrates a perspective bottom view of a schematic diagram of an embodiment of the power adapter 100 with the cable retention structure 105. In this example, the cable retention structure 105 is in an open position but without an attached power cable 150. The cable retention structure 105 includes a hinge 310 that moveably attaches the cable retention structure 105 to the power adapter 100. The hinge 310 allows the cable retention structure 105 to pivot and fold over into a recessed portion 300 of an exterior side of the adapter unit 115.

In the closed position, the cable grip 110 fits into the cable grip well 130. In an embodiment, the cable grip well 130 includes a friction pad 305. The friction pad 305 is affixed to one or more sides of the cable grip well 130 such that the cable grip 110 may lie against the friction pad 305. The friction pad 305 helps prevent damage to the cable grip 110 during opening and closing of the cable retention structure 105.

The cable grip 110 further includes one or more grip dimples 315*a* and 315*b*. The grip dimples 315*a-b* engage a lip or other type of protrusion in a front portion of the cable grip well 130. The grip dimples 315 help to secure the cable grip 110 within the cable grip well 130. When the cable grip 110 is moved into the cable grip well 130, the grip dimples 315 slide under the lip 320, and then the lip 320 frictionally holds the grip dimples 315 to secure the cable grip 110. To open the cable retention structure 105, leverage is applied to the opening structure 200 to push the grip dimples 315 outwards and away from under the lip 320. The cable grip 110 may then be pushed upwards to open the cable retention structure 105.

Figure 4:
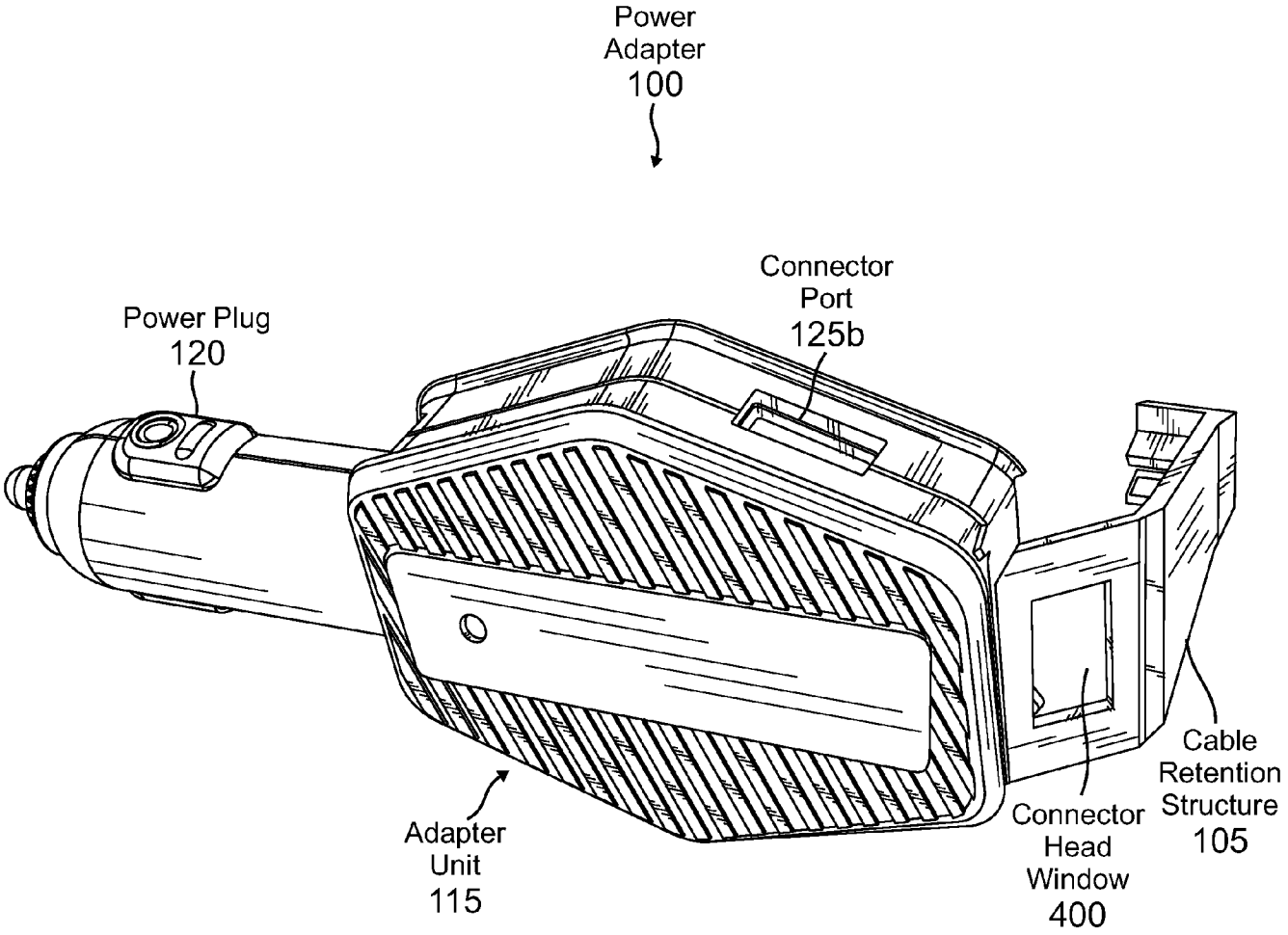
FIG. 4 illustrates a perspective top view of a schematic diagram of an embodiment of the power adapter with the cable retention structure in an open position.

FIG. 4 illustrates a perspective top view of a schematic diagram of an embodiment of the power adapter 100 with the cable retention structure. In this example, the cable retention structure 105 is in an open position but without an attached power cable 150. A connector head window 400 is cut-out from or formed within the cable retention structure 105. The connector head window 400 is positioned on the cable retention structure 105 to overlap the connector port 125*a* when the cable retention structure is in the closed position. The connector head window 400 provides access to the connector port 125*a* when the cable retention structure 105 is in a closed position. Thus, the connector port 125*a* may be used in both the open and closed positions of the cable retention structure 105.

The adapter unit 115 includes another connector port 125*b* positioned on another side of the adapter unit 115 from the first connector port 125*a*. In another embodiment, a plurality of connector ports 125 may be positioned on a single side of the adapter unit 115.

The top side and the bottom side described herein are opposite exterior sides of the adapter unit 115. In an embodiment, one or more components illustrated on the bottom side of the power charge mount may be implemented on the top side of the adapter unit. Conversely, one or more components illustrated on the top side of the power charge mount may be implemented on the bottom side of the adapter unit. For example, the cable retention structure may fold over a top side of the adapter unit and fit into the cable grip well that is formed within the top side of the adapter unit.

Figure 5:
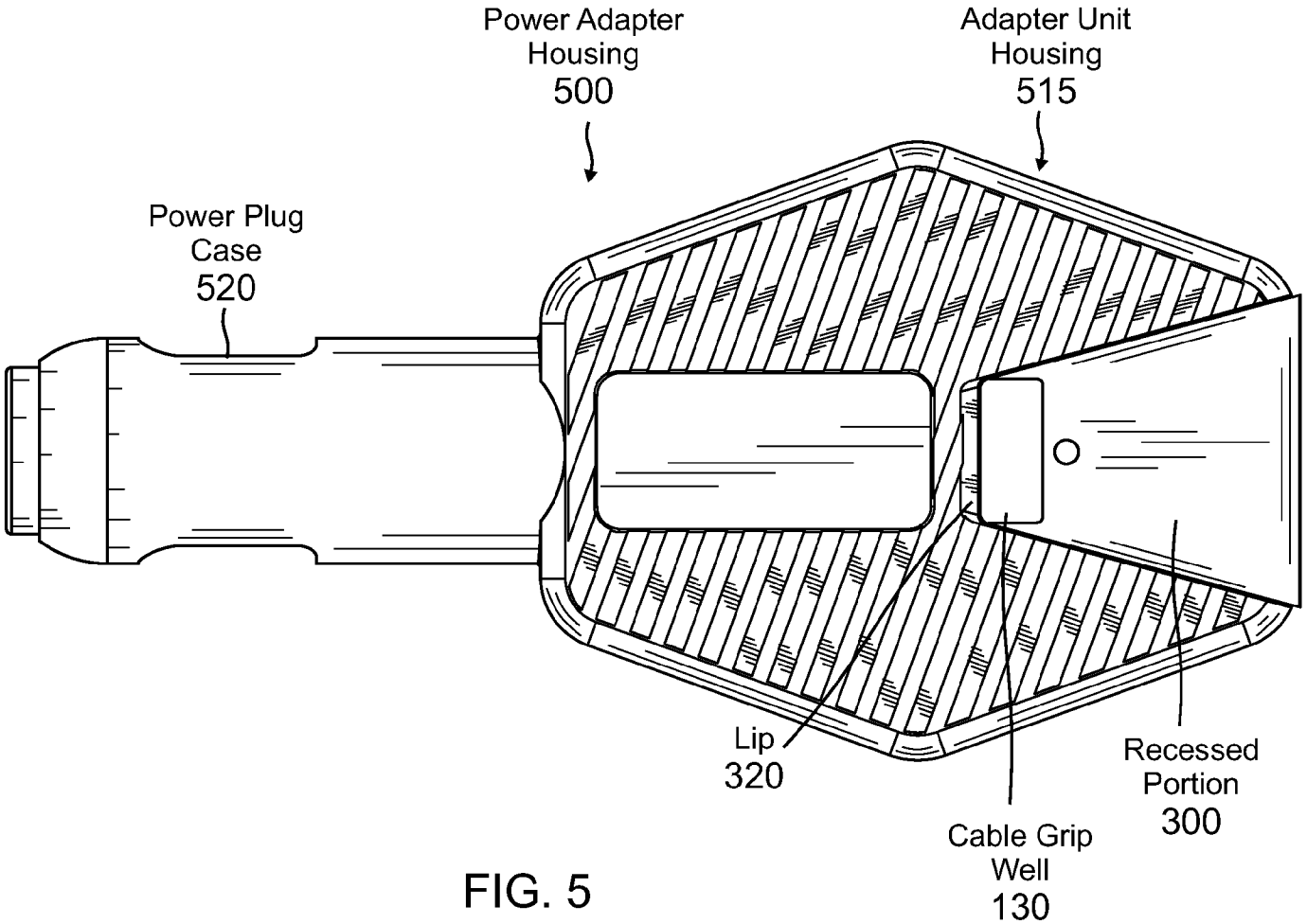
FIG. 5 illustrates a top view of a schematic diagram of an embodiment of a power adapter housing.

FIG. 5 illustrates a top view of a schematic diagram of an embodiment of a power adapter housing 500. The power adapter housing 500 forms the outer case or housing for the power adapter and its internal components. The power adapter housing 500 includes a power plug case 520 and an adapter unit housing 515. The cable grip well 130 and the recessed portion 300 are formed into the power adapter housing 500. The lip 320 protrudes into the cable grip well 130.

Figures 6A, 6B:
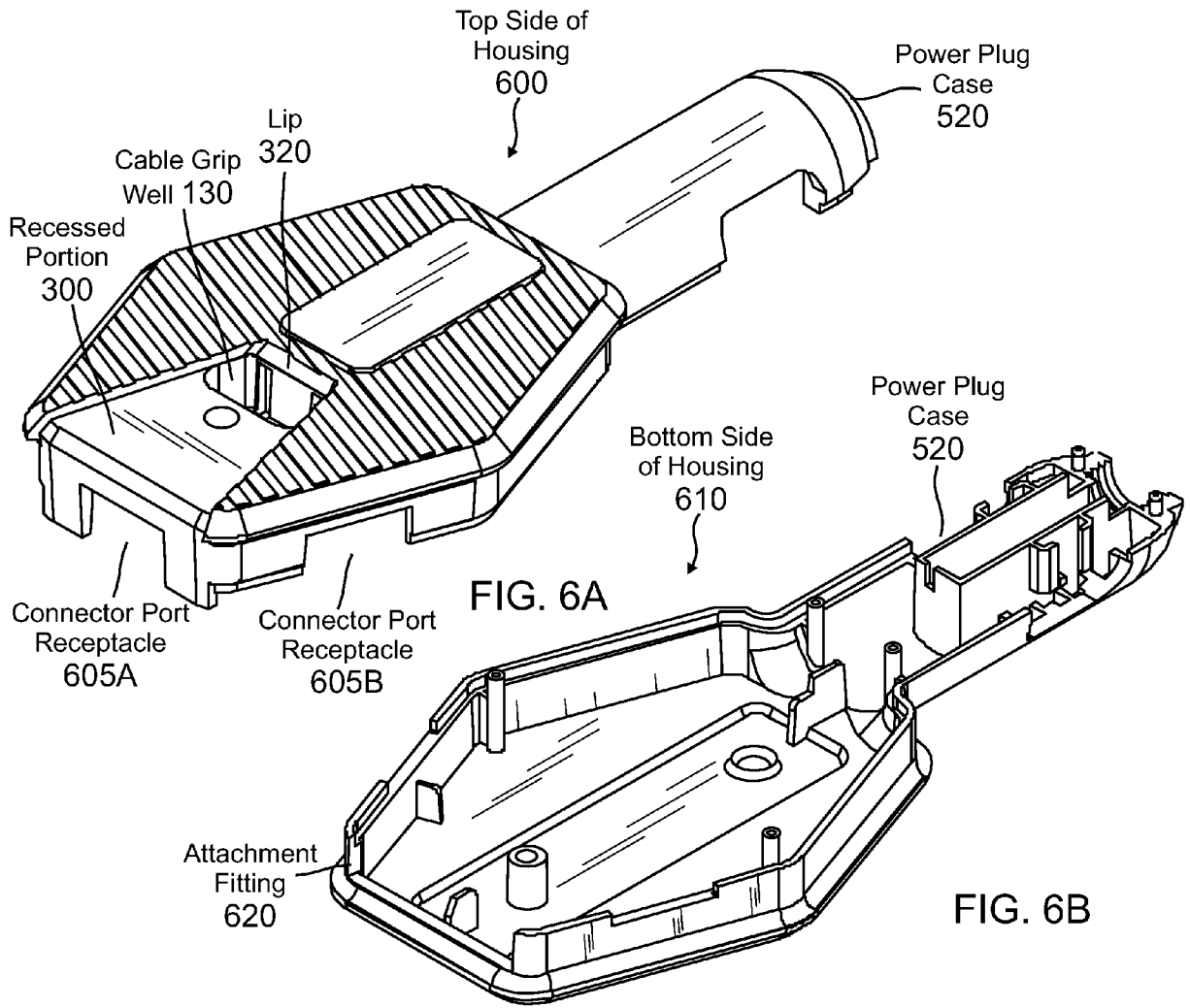
FIG. 6A illustrates a perspective view of the top side of the housing for the power adapter of FIG. 5.
FIG. 6B illustrates a perspective view of the bottom side of the housing for the power adapter charger of FIG. 5.

FIG. 6A and FIG. 6B illustrate perspective views of the top side of the power adapter housing 600 and the bottom side of the power adapter housing 610 respectively. Though the power adapter housing 500 is formed by two parts 600 and 610 in this embodiment, the power adapter housing 500 may be implemented with additional and/or alternative parts as well. In addition, though the top side of the housing 600 is shown as a single part, it may alternatively be formed by a plurality of parts. Similarly, though the bottom side of the housing 610 is shown as a single part, it may alternatively be formed from a plurality of parts.

The top side of the power adapter housing 600 forms connector port receptacles 605A and 605B in which the connector ports 125 may reside. The cable grip well 130 and the recessed portion 300 are formed into the top side of the housing 600. The lip 320 is formed to protrude into the cable grip well 130.

The bottom side of the power adapter housing 610 includes an attachment fitting 620 for attaching the cable retention structure 105 to the power adapter 100. For example, the attachment fitting 620 may include a hinge or connectors for a hinge extending horizontally along the side or on the side or in proximity to a side that houses the connector port receptacle 605A. Alternatively, the attachment fitting 620 may be configured to include other types of attachment mechanisms, such as a t-hinge, gate hinge, strap hinge, or another type of hinge, ball/socket joint or other movable joint, or other mechanism, that allows the cable retention structure 105 to move with respect to the adapter unit 115.

Exemplary Embodiments of the Cable Retention Structure

Figure 7A:
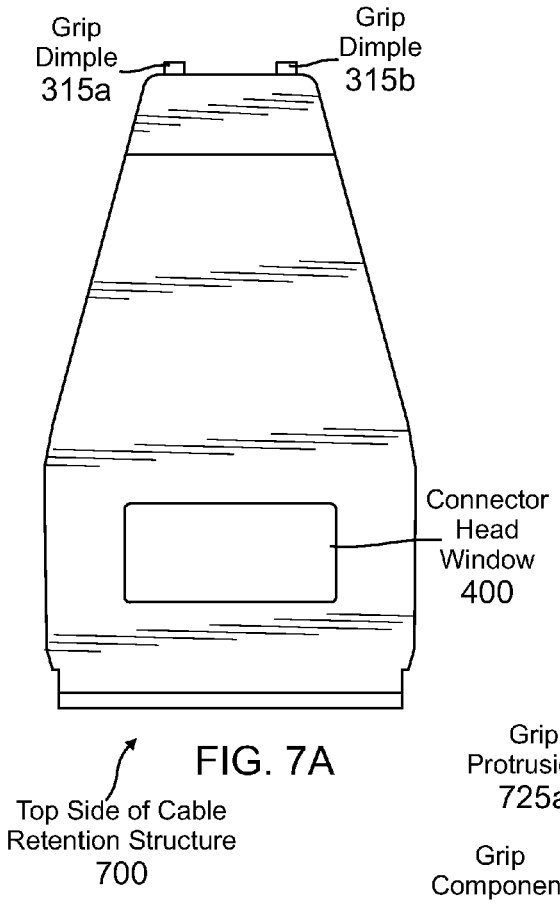
FIG. 7A illustrates a schematic diagram of an embodiment of a top view of a cable retention structure.
Figure 7B:
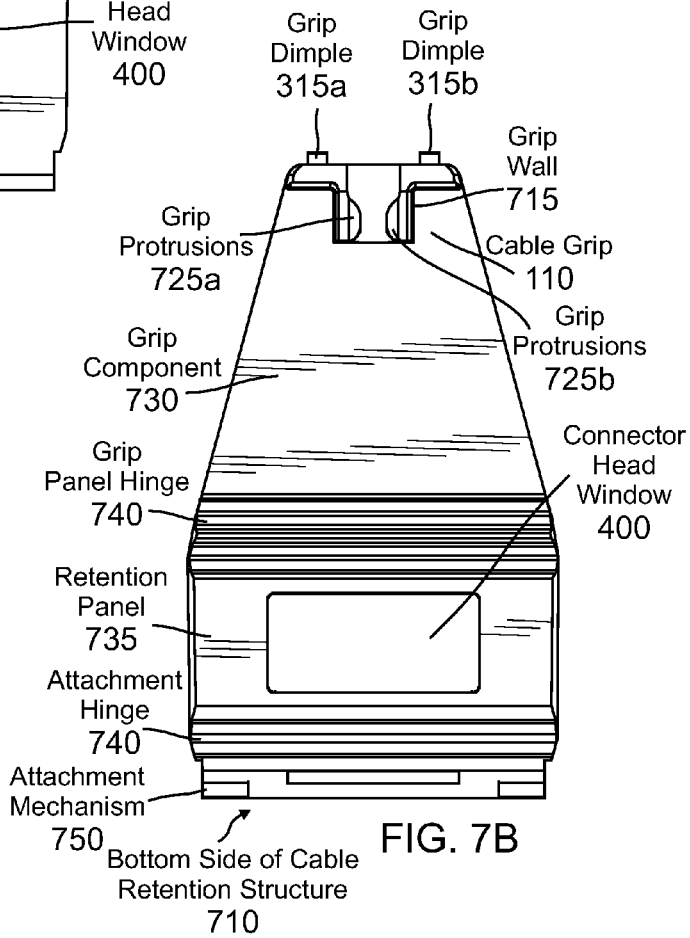
FIG. 7B illustrates a schematic diagram of an embodiment of a bottom view of the cable retention structure of FIG. 7A.

FIG. 7A and FIG. 7B illustrate perspective views of the top side of the cable retention structure 700 and the bottom side of the cable retention structure 710 respectively. As shown in FIG. 7A, the top side of the cable retention structure 700 includes a cable grip 110 with one or more protruding grip dimples 315*a* and 315*b*. The cable retention structure 700 has a connector head window 400 formed therein.

As shown in FIG. 7B, the cable grip 110 includes u-shaped cable grip walls 715 that form a grip opening 720. One or more grip protrusions 725*a* and 725*b* extend or project into the grip opening 720. The grip protrusions 725 assist in applying pressure to clasp the power cable 150 and hold it within the cable grip opening 720.

The cable retention structure 105 also includes an attachment mechanism 750. The attachment mechanism 750 attaches or couples to the attachment fitting 620 of the adapter unit 115. The attachment mechanism 750 may include, e.g. a t-hinge, gate hinge, strap hinge, or another type of hinge, ball/socket joint or other movable joint, or other mechanism, that allows the cable retention structure 105 to move with respect to the adapter unit 115 between an open and closed position.

In an embodiment, an attachment hinge 745 is positioned between the attachment mechanism 750 and a retention panel 735. The attachment hinge 745 is a living hinge including a thinner flexible portion or folded portion of the material of the cable retention structure. For example, the cable retention structure 105 may bend or fold along the line of the attachment hinge 745. When the attachment hinge 745 bends, the retention panel 735 folds over a side of the adapter unit 115 into the closed position.

In an embodiment, the connector head window 400 is formed within the retention panel 735 to provide access to a connector port 125 positioned underneath the cable retention structure 105 in the closed position. Thus, the connector port 125 may be used in both the open and closed positions of the cable retention structure 105.

The cable grip 110 is mounted to a grip component 730. The grip component 730 provides support for the cable grip 110 and is sized to position the cable grip 110 over the cable grip well 130 when the cable retention structure 105 is in a closed position. The grip component 730 may include an arm, panel or other structure. In the example shown in FIG. 7, the grip component 730 has tapered sides though in other embodiments, the grip component may have other shapes and sizes.

A grip hinge 740 is formed between the retention panel 735 and the grip component 730. In an embodiment, the grip hinge 740 is a living hinge including a thinner flexible portion or folded portion of the cable retention material. For example, the material may be thinned or cut to allow the cable retention structure 105 to bend or fold along the line of the flexible portion. The grip hinge 740 bends to position the grip component 730 over the recessed portion 300 of the adapter unit 115, e.g., when the cable retention structure 105 is in a closed position.

Figure 8B:
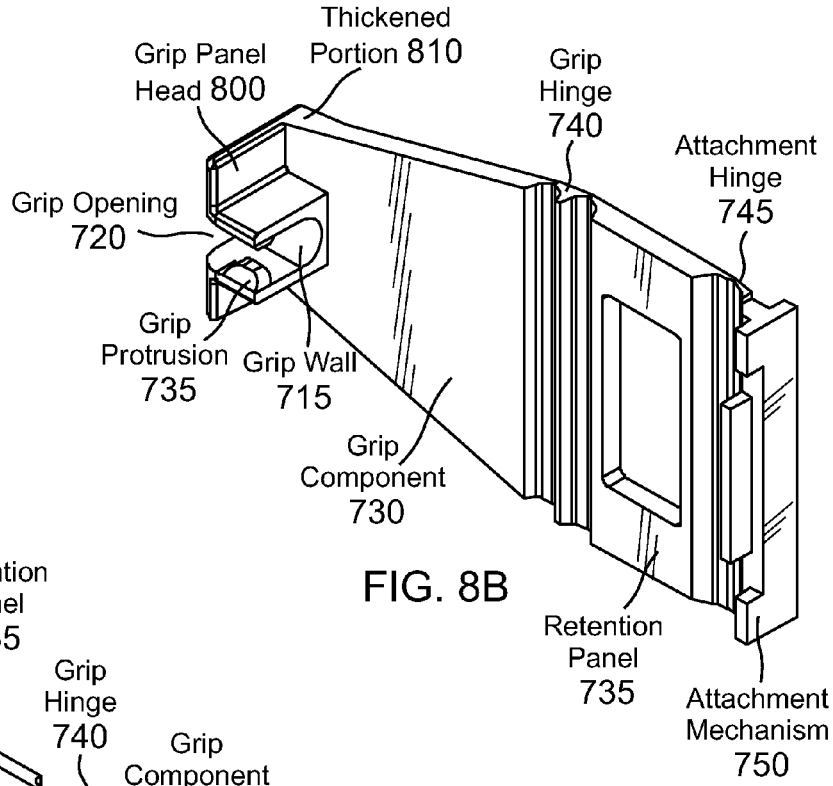
FIG. 8B illustrates a perspective bottom view of an embodiment of the cable retention structure of FIG. 8A.
Figure 8A:
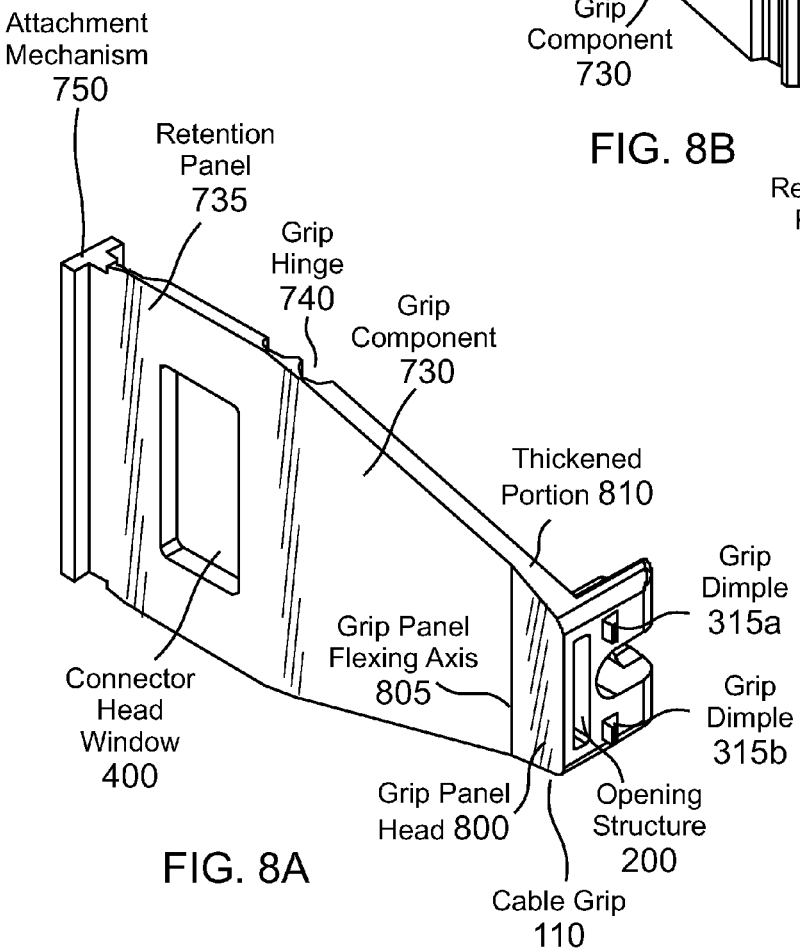
FIG. 8A illustrates a perspective top view of an embodiment of the cable retention structure.

FIG. 8A illustrates a perspective top view of an embodiment of the cable retention structure 105. A grip panel head 800 is formed at a thickened portion 810 of the material of the cable retention structure 105 along a grip panel axis 805. The grip panel head 800 flexes along the grip panel axis 805. This flexing ability assists the grip panel head 800 to be inserted into and removed from the cable grip well 130.

FIG. 8B illustrates a perspective bottom view of an embodiment of the cable retention structure of FIG. 8A. FIG. 8B illustrates a bottom view of the grip panel head 800, and the thickened portion 810 of the material of the cable retention structure 105. In an embodiment, the material of the cable retention structure 105 includes a polycarbonate material or other thermoplastic polymer type material or other plastic material. In another embodiment, the material of the cable retention structure 105 includes a metal or metal alloy. In yet another embodiment, the material of the cable retention structure 105 includes a rubber type material. In another embodiment, the cable retention structure 105 includes a plurality of materials. For example, components of the attachment mechanism 750 may include a metal or metal alloy material and the retention panel and grip component may include a plastic material. Other materials or combinations of materials may be employed to construct the cable retention structure 105.

Figure 9A:
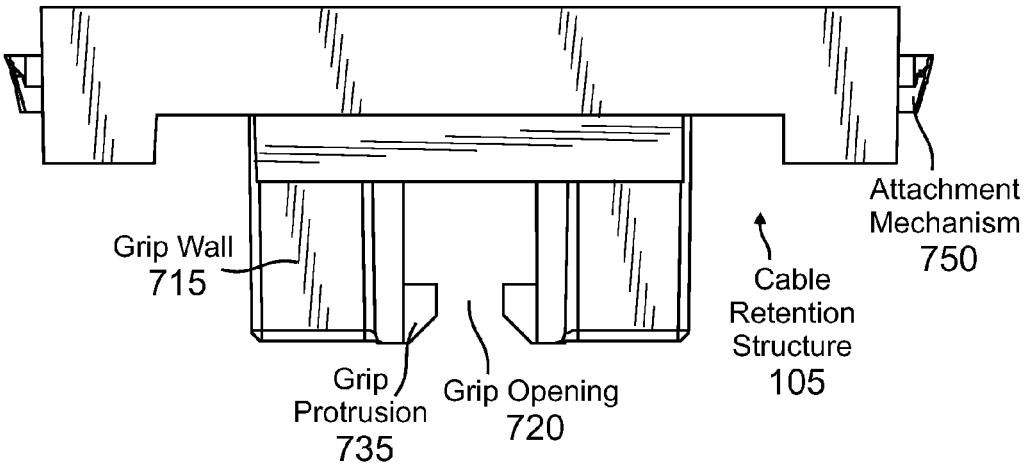
FIG. 9A illustrates a schematic diagram of an embodiment of a first end of the cable retention structure of FIG. 6A.

FIG. 9A illustrates a schematic diagram of an embodiment of an end of the cable retention structure 105. The cable retention structure 105 is shown along a cross-section of an end of the attachment mechanism 750. The grip opening 720 is formed by grip wall 720. The grip wall 720 may include a single formed wall or include a plurality of walls to form an approximately u-shape grip or semi-circle grip opening 720.

The profile of the grip protrusions 725*a* and 725*b* in the grip opening 720 is illustrated. The grip protrusions 725*a* and 725*b* decrease the opening area such that the grip protrusions 725 hold a power cable within the grip opening 720. In other aspects, alternative structures may be implemented as the cable grip 110, such as a latch with a catch and lever, a clasp, etc.

Figure 9B:
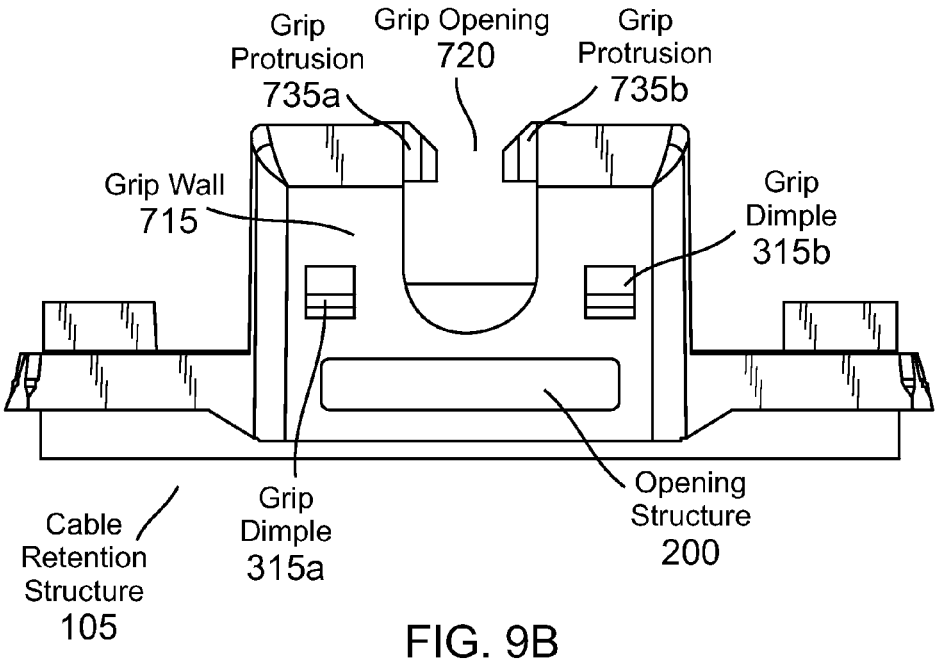
FIG. 9B illustrates a schematic diagram of an embodiment of a second end of the cable retention structure of FIG. 6A.

FIG. 9B illustrates a schematic diagram of an embodiment of another end of the cable retention structure of FIG. 9A. The cable retention structure 105 is shown along a cross-section of the end of the cable grip 110. In an embodiment the grip opening 720 is configured to hold a standardized USB cable. For example, the grip opening 720 has a width of approximately 4.00 mm and a depth of approximately 4.70 mm. The grip protrusions 725 protrude within a top portion of the grip opening 720 to decrease the width within that top portion to frictionally hold the power cable within the cable opening 720. The grip wall 720 may include a single formed wall or include a plurality of walls to form an approximately u-shape grip or semi-circle grip opening 720.

Though a width of approximately 4.00 mm and a depth of approximately 4.70 mm are described herein, other dimensions may be implemented. For example, in an embodiment, the power adapter 100 includes a plurality of different types of connector ports. In this embodiment, a plurality of cable retention structures 105 may be implemented with different sized cable grip openings 720 configured to clasp a standardized power cable for such one or more different types of connector ports.

Additional Exemplary Embodiments of the Power Adapter

Figure 10:
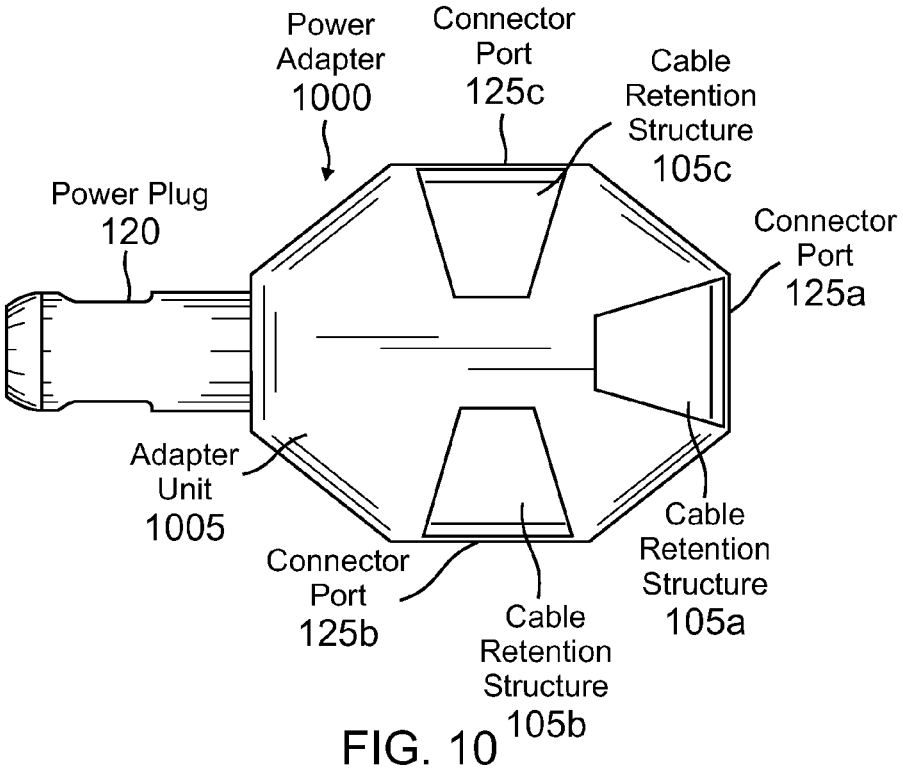
FIG. 10 illustrates a schematic diagram of another embodiment of a power adapter with a cable retention structure.

FIG. 10 illustrates a schematic diagram of another embodiment of a power adapter 1000 with a cable retention structure. In this embodiment, an adapter unit 1005 has a generally octagonal shape. At least one connector port 125 and cable retention structure 105*a* are situated at one side of the octagonal shaped adapter unit 1005. In another embodiment, a second connector port 125*b* and cable retention structure 105*b* are situated at a second side of the octagonal shaped adapter unit 1005. In another embodiment, a third connector port 125*c* and cable retention structure 105*c* are situated at a third side of the octagonally shaped adapter unit 1005.

Figure 11:
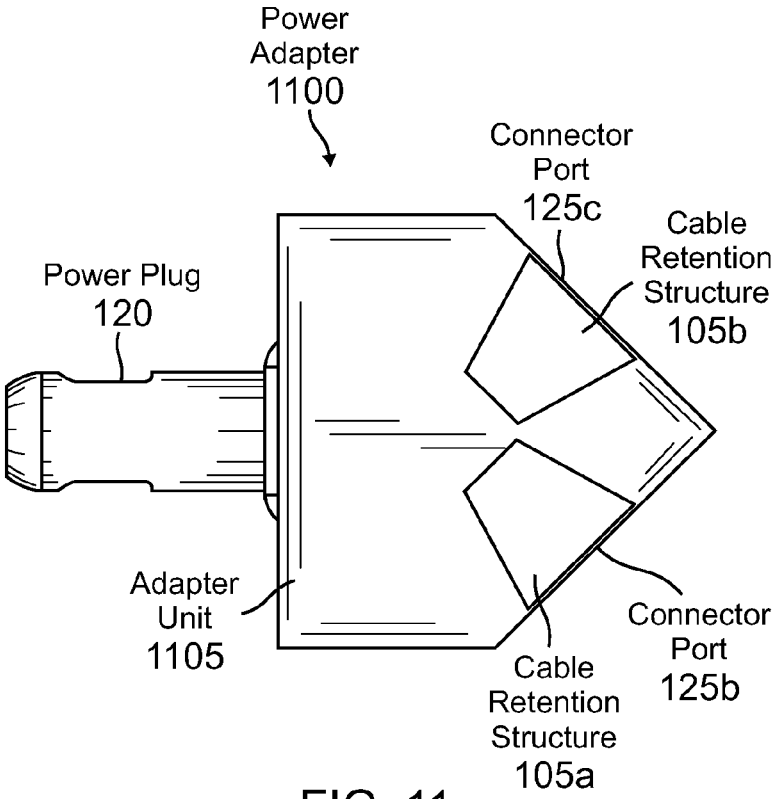
FIG. 11 illustrates a schematic diagram of another embodiment of a power adapter with a cable retention structure.

FIG. 11 illustrates a schematic diagram of another embodiment of a power adapter 1100 with a cable retention structure 105. In this embodiment, an adapter unit 1105 has a generally pentagonal shape. At least one connector port 125*a* and cable retention structure 105*a* are situated at one side of the pentagonal shaped adapter unit 1105. In another embodiment, a second connector port 125*b* and cable retention structure 105*b* are situated at a second side of the pentagonal shaped adapter unit 1105. Other shapes of the adapter unit than those illustrated herein may also be implemented.

Figure 12:
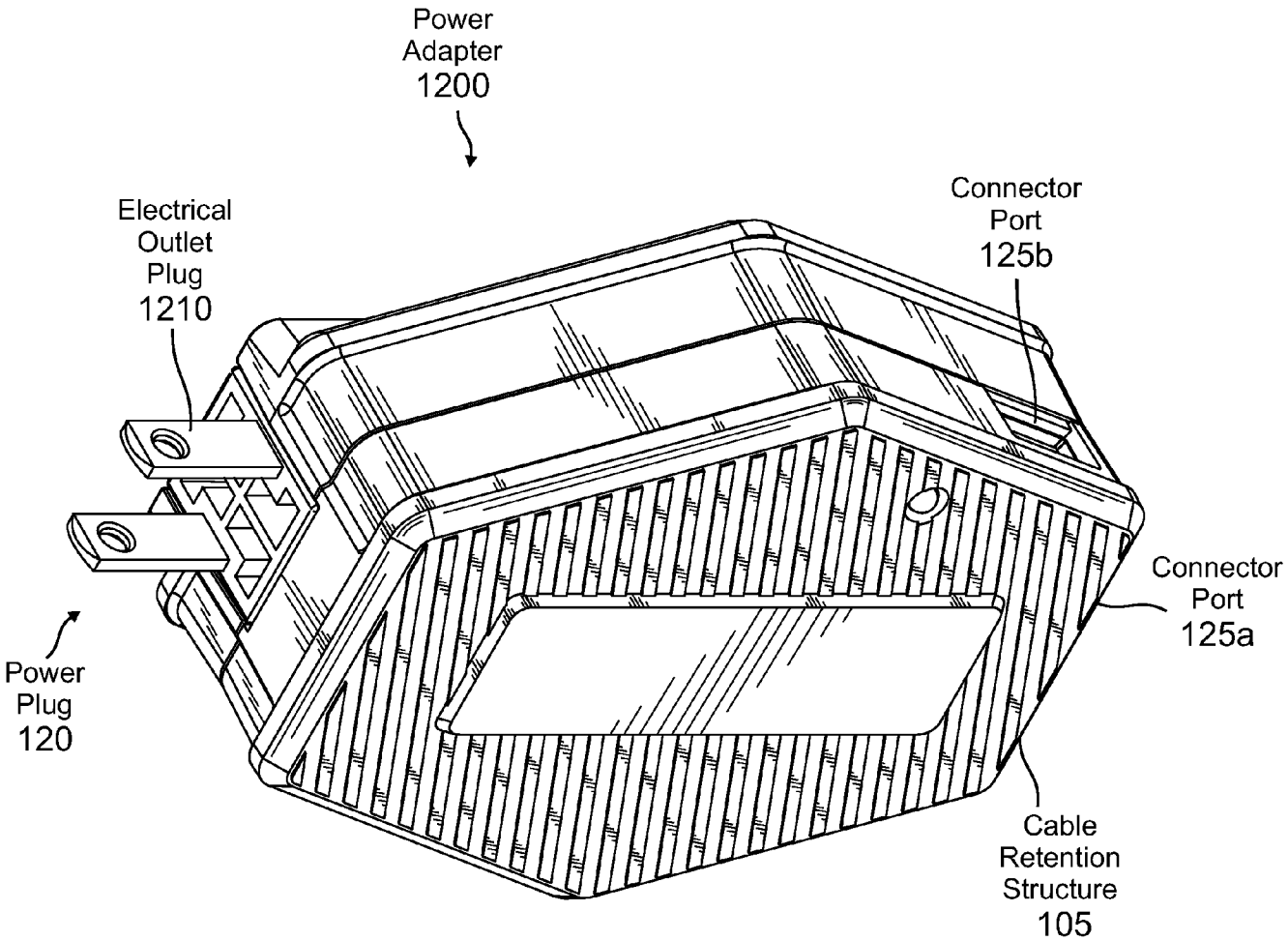
FIG. 12 illustrates a schematic diagram of another embodiment of a power adapter with a cable retention structure.

FIG. 12 illustrates a schematic diagram of another embodiment of a power adapter 1200 with a cable retention structure. In this embodiment, the adapter unit 1205 includes an electrical outlet plug 1210. The power plug 120 thus may include an electrical outlet plug 1205 or a cigarette adapter power plug or other type of power plug 120 adapted to connect with a power source.

Exemplary Embodiments of Other Devices with a Cable Retention Structure

In the embodiments described above, the cable retention structure 105 has been described for use with a power adapter. The cable retention structure 105 may also be implemented for use on other types of devices.

Figure 13:
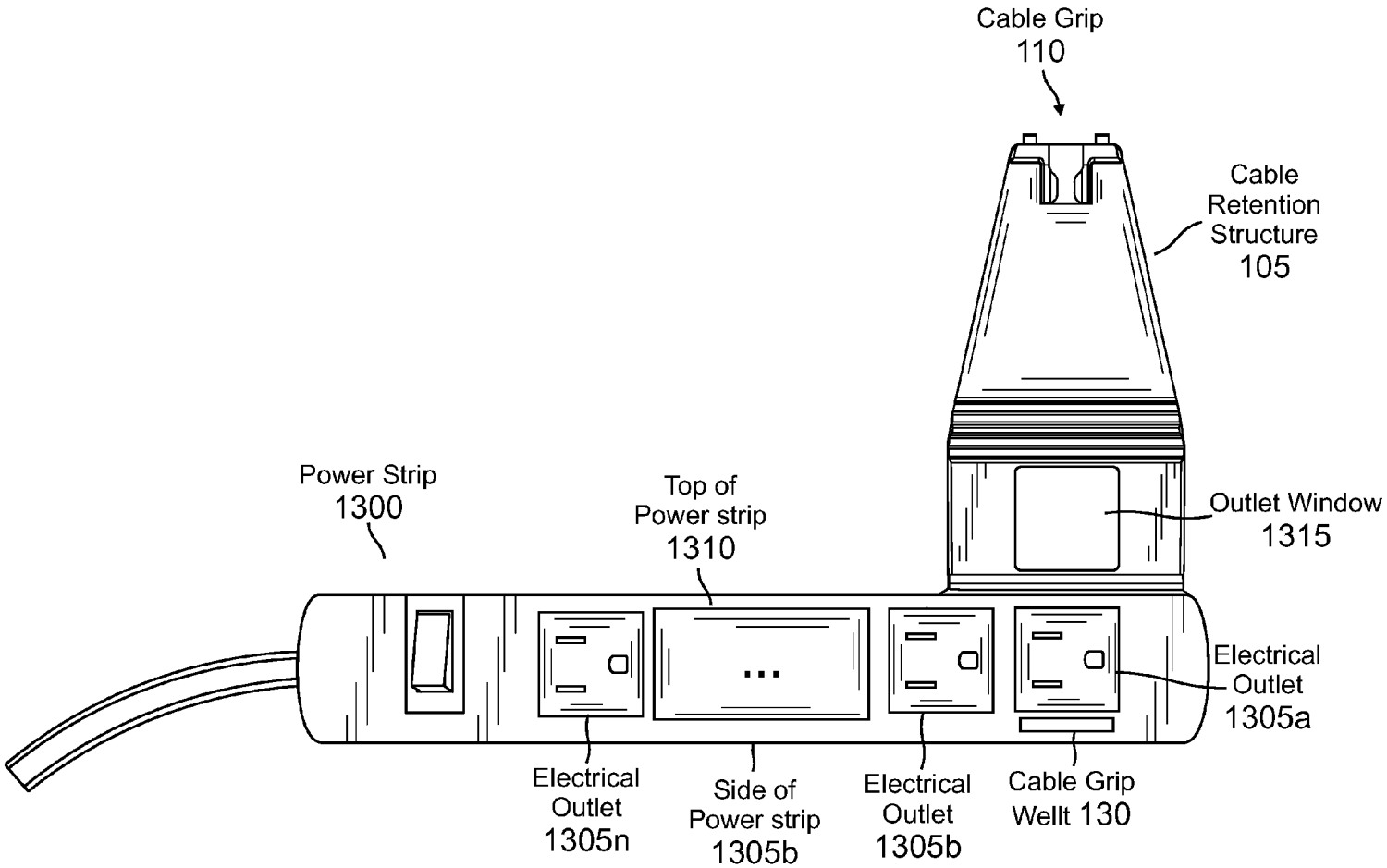
FIG. 13 illustrates a schematic diagram of an embodiment of a power strip with a cable retention structure.

FIG. 13 illustrates a schematic diagram of an embodiment of a power strip 1300 with a cable retention structure 105. The power strip 1300 includes a plurality of electrical outlets 1305*a-n*. The cable retention structure 105 is moveably attached to the power strip 1300 to move between an open position and a closed position. The attachment mechanism may include, e.g. t-hinge, gate hinge, strap hinge, or another type of hinge, ball/socket joint or other movable joint, or other mechanism, that allows the cable retention structure 105 to move with respect to the power strip 1300 between an open and closed position.

In an open position, the cable grip 110 is configured to hold a power cable plugged into one of the electrical outlets 1305, e.g. electrical outlet 1305*a* in FIG. 13. The cable grip 110 holds the power cable and helps to resist disconnection of the power cable from the power strip 1300.

In a closed position, the cable retention structure 105 moves to fold over the top of the power strip 1310 to the side of the power strip 1315. The cable grip 110 fits into a cable grip well 130 in the side of the power strip 1300 and is frictionally held within the cable grip well 130 to secure the cable retention structure 105 in the closed position. An outlet window 1315 is formed in the cable retention structure 105 and overlaps the electrical outlet 1305*a*. The electrical outlet 1305*a* may thus be used when the cable retention structure 105 is in an open or closed position.

Figure 14:
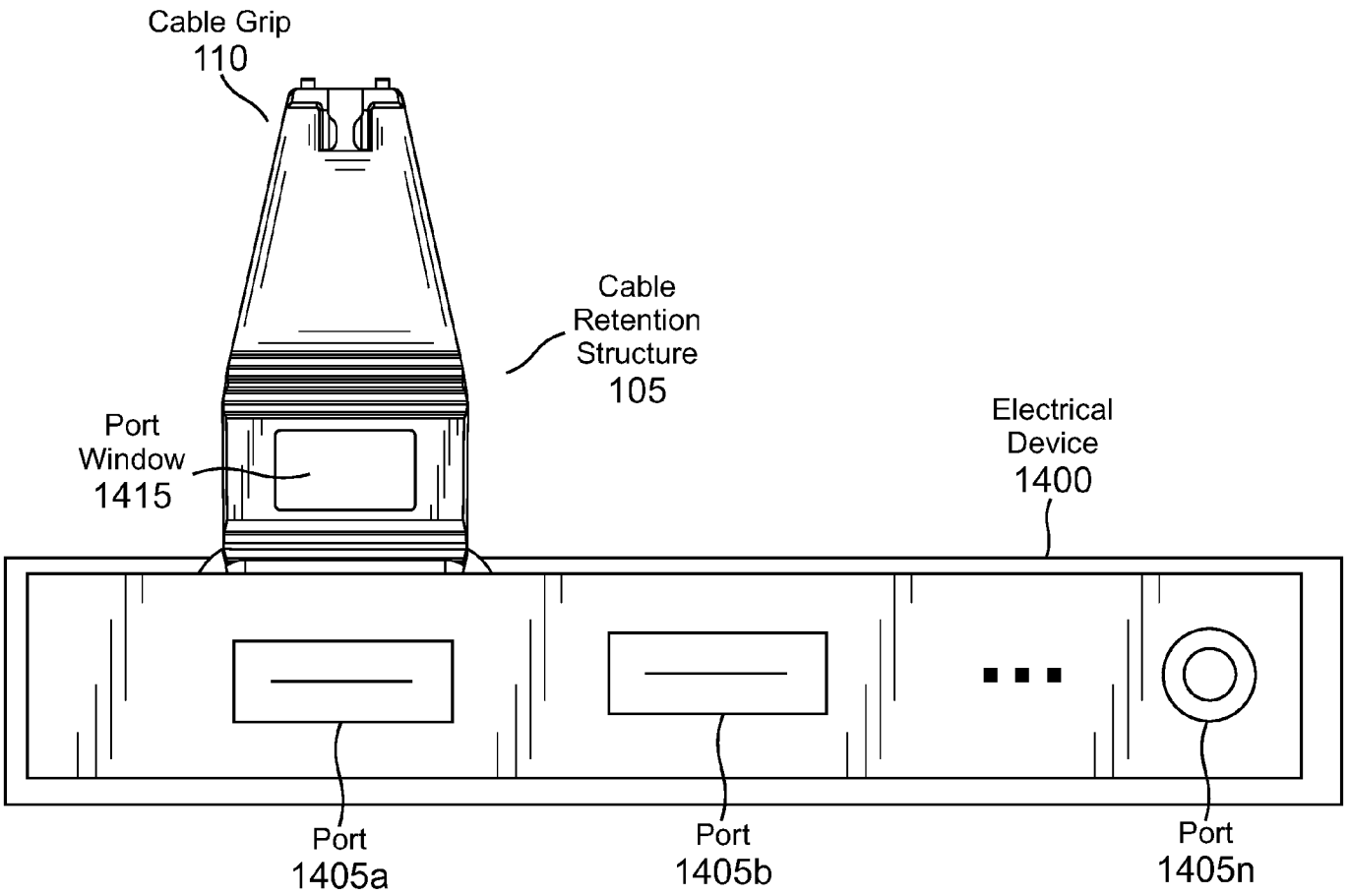
FIG. 14 illustrates a schematic diagram of an embodiment of an electrical device with a cable retention structure.

FIG. 14 illustrates a schematic diagram of an embodiment of an electrical device 1400 with a cable retention structure 105. The electrical device 1400 includes any type of device that includes one or more ports 1405 for communicating data or for connection to a power supply. For example, the electrical device 1400 may include a laptop, a server, a television, a set top box, a mobile phone, smart tablet, modem, vehicle, appliance, etc. The ports 1405*a-n* may include a data port, such as a High Definition Multimedia Interface (HDMI) port, USB port, digital visual interface (DVI) port, video graphic array (VGA), RJ45 port, phone connector ports, or other types of port for communicating data through a data cable to the electrical device 1400. The ports 1405*a-n* may also include a power port, as described herein, such as a type of USB port, an IEEE 802.3af Power over Ethernet (PoE) port, a MIDI port, or other type of port operable to supply power through a cable or cord to the electrical device 1400.

The cable retention structure 105 is moveably attached to the electrical device 1400 to move between an open position and a closed position. The attachment mechanism may include, e.g. t-hinge, gate hinge, strap hinge, or another type of hinge, ball/socket joint or other movable joint, or other mechanism, that allows the the cable retention structure 105 to move with respect to the electrical device 1400 between an open and closed position.

In an open position, the cable grip 110 is configured to hold a cable plugged into one of the ports 1405, e.g. port 1405*a* in FIG. 14. The cable may be a data cable, power cable, or combination thereof. The cable grip 110 holds the cable and helps to resist disconnection of the cable from the port 1405*a*.

In a closed position, the cable retention structure 105 moves to fold over a side of the electrical device 1400. The cable grip 110 fits into a cable grip well (not shown in FIG. 14) in the side of the electrical device 1400 and is frictionally held within the cable grip well to secure the cable retention structure 105 in the closed position. A port window 1315 is formed in the cable retention structure 105 and overlaps the port 1405*a*. The port 1405*a* may thus be used when the cable retention structure 105 is in an open or closed position.

Additional Exemplary Embodiments of the Cable Retention Structure

The cable retention structure 105 described herein may have one or more implementations or alternative structures.

Figure 15:
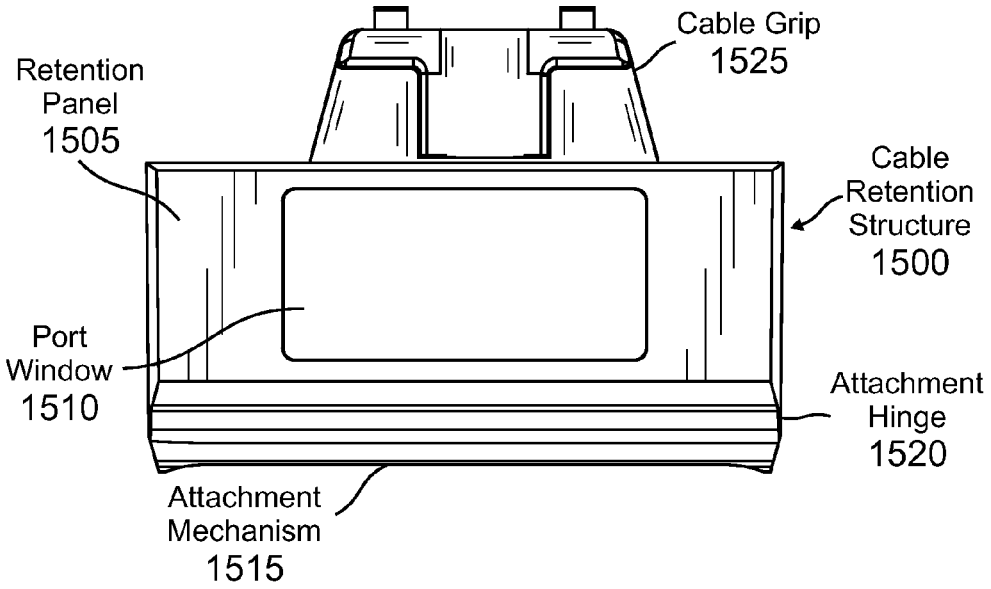
FIG. 15 illustrates a schematic diagram of another embodiment of a cable retention structure.

FIG. 15 illustrates a schematic diagram of another embodiment of a cable retention structure 1500. The cable retention structure 1500 includes a retention panel 1505 and an attachment mechanism 1515 to moveably attach the cable retention structure 1500 to a device. An attachment hinge 1520 is positioned between the attachment mechanism 1515 and the retention panel 1505. The attachment hinge 1520 is a living hinge including a thinner flexible portion or folded portion of the material of the cable retention structure 1500. For example, the cable retention structure 1500 may bend or fold along the line of the attachment hinge 1520. When the attachment hinge 1520 bends, the retention panel 1505 folds over a side of a device to a closed position. In an embodiment, a port window 1510 is formed within the retention panel 1505. In the closed position, the port window 1510 overlaps the connector port 105. Thus, the connector port 125 may be used in both the open and closed positions of the cable retention structure 105.

In this embodiment, a cable grip 1525 is mounted to the retention panel 1505. The retention panel 1505 is sized to position the cable grip 1525 over a cable grip well when the cable retention structure 1500 is in a closed position. The retention panel 1505 may include an arm, panel or other structural support.

Figure 16:
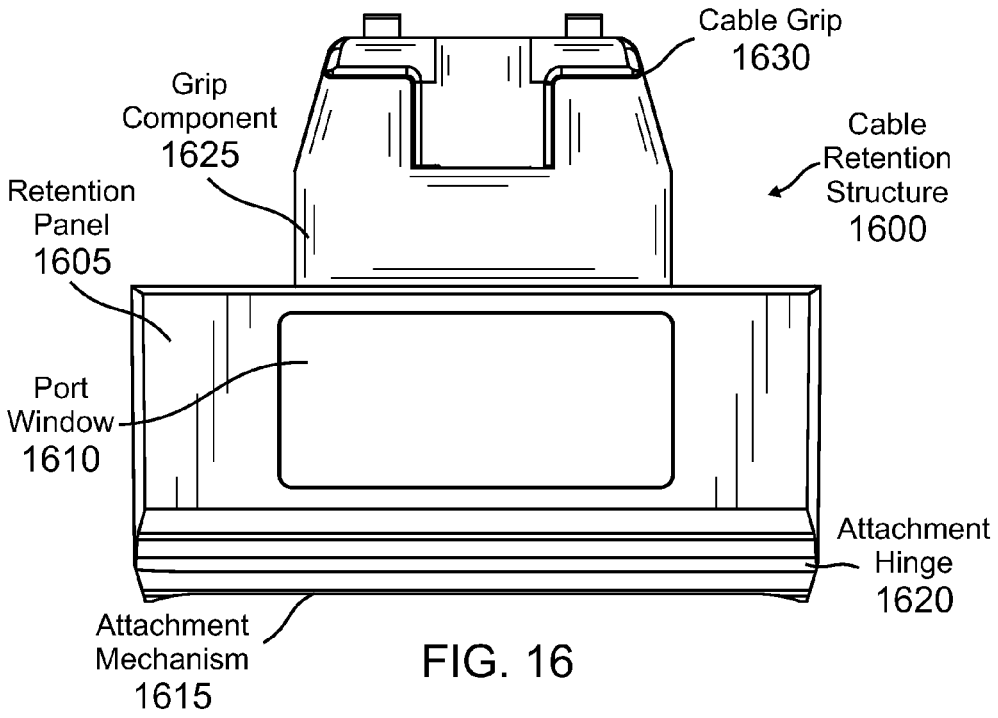
FIG. 16 illustrates a schematic diagram of another embodiment of a cable retention structure.

FIG. 16 illustrates a schematic diagram of another embodiment of a cable retention structure 1600. The cable retention structure 1600 includes a retention panel 1605 and an attachment mechanism 1615 that moveably attaches the cable retention structure 1600 to a device. An attachment hinge 1620 is positioned between the attachment mechanism 1615 and the retention panel 1605. In an embodiment, a port window 1610 is formed within the retention panel 1605 to provide access to a connector port positioned underneath the cable retention structure 1600 in the closed position. Thus, the connector port may be used in both the open and closed positions of the cable retention structure 1600.

The cable retention structure 1600 also includes a cable grip 1630 mounted to a grip component 1625. The grip component 1625 provides support for the cable grip 1630 and is sized to position the cable grip 1630 over a cable grip well when the cable retention structure 1600 is in a closed position. The grip component 1625 may include an arm, panel or other structure. In the example shown in FIG. 16, the grip component 1625 has a rectangular shape though in other embodiments, the grip component 1625 may have other shapes and sizes.

In one or more embodiments described herein, a cable retention structure is coupled to a device to move between an open position and a closed position. In an open position, a cable grip part of the cable retention structure is configured to firmly clasp a cable. This helps to prevent the disconnection of a connector of the cable from a port of the device. In a closed position, the cable retention structure moves to fold over a side of the device. The cable grip part of the cable retention structure fits into a cable grip well in the side of the device and is frictionally held within the cable grip well to secure the cable retention structure in the closed position.

In the foregoing specification, certain representative aspects of the invention have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. §112(f), unless the element is expressly recited using the phrase "means for" or, in the case of a method claim, the element is recited using the phrase "step for."

The invention claimed is:

1. A power adapter, comprising:

an adapter unit, including:

a power plug mounted to a first side of the adapter unit; and a connector port in a second side of the adapter unit, wherein the connector port is configured for coupling to a connector head of a power cable;

a cable retention structure attached to the adapter unit, wherein the cable retention structure includes a cable grip configured to hold the power cable;

an attachment mechanism that moveably attaches the cable retention structure to the adapter unit, wherein the cable retention structure is operable to move between an open position and a closed position; and wherein an opening is formed within the cable retention structure, wherein the opening is positioned to overlap the connector port when the cable retention structure is in the closed position.

2. The power adapter of claim 1, wherein the cable grip comprises:

at least one grip wall that forms a generally u-shaped grip opening; and at least one grip protrusion that protrudes from the grip wall, wherein the at least one grip protrusion is configured for frictionally clasping the power cable.

3. The power adapter of claim 2, wherein the at least one grip protrusion is configured for frictionally clasping the power cable when the cable retention structure is in the open position.

4. A power adapter, comprising:

an adapter unit, including:

a power plug mounted to a first side of the adapter unit; and a connector port in a second side of the adapter unit, wherein the connector port is configured for coupling to a connector head of a power cable;

a cable retention structure attached to the adapter unit, wherein the cable retention structure includes a cable grip configured to hold the power cable, wherein the cable retention structure further comprises:

a grip component coupled to the cable grip; and a grip hinge coupled between the grip component and the attachment mechanism, wherein the grip hinge is configured to fold the grip component over an exterior side of the adapter unit, wherein the grip hinge is configured to fold the grip component across the exterior side of the adapter unit when the cable retention structure is in the closed position; and wherein the adapter unit further comprises a cable grip well that is formed within the exterior side of the adapter unit, wherein the cable grip well is configured to hold the cable grip when the cable retention structure is in the closed position.

5. The power adapter of claim 4, wherein the power plug includes at least one of: a cigarette lighter power plug or an electrical outlet plug.

6. A device, comprising:

an adapter unit;

a connector port housed in the adapter unit, wherein the connector port is configured for coupling to a connector of a cable; and a cable retention structure attached to the adapter unit, wherein the cable retention structure includes:

a cable grip mounted on the cable retention structure, wherein the cable grip is configured to hold the cable;

an attachment mechanism that moveably attaches the cable retention structure to the adapter unit, wherein the cable retention structure is operable to move between an open position and a closed position; and wherein a window is formed within the cable retention structure and positioned to overlap the connector port when the cable retention structure is moved to the closed position.

7. The device of claim 6, wherein the adapter unit further comprises:

a power plug mounted to the adapter unit.

8. The device of claim 6, wherein the cable grip comprises:

at least one grip wall that forms a u-shaped grip opening; and at least one grip protrusion that protrudes from the grip wall, wherein the at least one grip protrusion is configured for frictionally holding the cable.

9. The device of claim 8, wherein the at least one grip protrusion is configured for frictionally holding the cable when the cable retention structure is in the open position.

10. The device of claim 6, wherein the cable retention structure further comprises:

a grip component coupled to the cable grip; and a grip hinge coupled between the grip component and the attachment mechanism, wherein the grip hinge is configured to fold the grip component across an exterior side of the adapter unit when the cable retention structure is in the closed position.

11. The device of claim 6, wherein the connector port housed in the adapter unit comprises at least one of: a Universal Serial Bus (USB) port, a mini-USB port, a micro-USB port, or an IEEE 802.3af Power over Ethernet (PoE) port.

12. A device, comprising:

a port housed in the device, wherein the port is configured for coupling to a connector of a cable;

a cable retention structure attached to the device, wherein the cable retention structure is configured to grip the cable;

an attachment mechanism that moveably attaches the cable retention structure to the device, wherein the cable retention structure is operable to move between an open position and a closed position;

a recessed portion formed in an exterior side of the device; and a grip panel hinge coupled between the grip component and the attachment mechanism, wherein the grip hinge is configured to fold the grip component at least partially within the recessed portion formed in the exterior side of the device when the cable retention structure is in the closed position.

13. The device of claim 12, wherein the cable retention structure comprises:

a cable grip mounted on the cable retention structure, wherein the cable grip is configured to clasp the cable.

14. The device of claim 13, wherein the cable grip comprises:

at least one grip wall that forms a grip opening; and at least one grip protrusion that protrudes from the grip wall, wherein the at least one grip protrusion is configured for frictionally clasping the cable.

15. The device of claim 12, wherein the cable retention structure further comprises:

a cable grip well that is formed within the exterior side of the adapter unit, wherein the cable grip well is configured to hold the cable grip when the cable retention structure is in the closed position.

16. The device of claim 12, wherein the cable retention structure further comprises:

an attachment mechanism that moveably attaches the cable retention structure to the adapter unit, wherein the cable retention structure is operable to move between an open position and a closed position; and wherein an opening formed within the cable retention structure is positioned to overlap the connector port when the cable retention structure is in the closed position.

* * * * *